US006712217B2

(12) United States Patent
Kremer et al.

(10) Patent No.: US 6,712,217 B2
(45) Date of Patent: Mar. 30, 2004

(54) AGENT FOR DRESSING PHOSPHATE ORE

(75) Inventors: Dr. Gernot Kremer, Kelkheim (DE); Klaus Ulrich Pedain, Steinberg (DE); Juan Balassa, Mexico (MX); Pablo Lopez, Mexico (MX)

(73) Assignee: Clariant International, Ltd., Muttenz (CH)

( * ) Notice: Subject to any disclaimer, the term of this patent is extended or adjusted under 35 U.S.C. 154(b) by 0 days.

(21) Appl. No.: 10/276,211

(22) PCT Filed: May 3, 2001

(86) PCT No.: PCT/EP01/04964

§ 371 (c)(1),
(2), (4) Date: Nov. 14, 2002

(87) PCT Pub. No.: WO01/87490

PCT Pub. Date: Nov. 22, 2001

(65) Prior Publication Data

US 2003/0146136 A1 Aug. 7, 2003

(30) Foreign Application Priority Data

May 18, 2000 (DE) ..... 100 24 667

(51) Int. Cl.[7] ..... B03D 1/008; B03D 1/016; B03D 1/02

(52) U.S. Cl. ..... 209/166; 252/61

(58) Field of Search ..... 209/166; 252/61

(56) References Cited

U.S. PATENT DOCUMENTS

| | | | | |
|---|---|---|---|---|
| 4,110,207 A | * | 8/1978 | Wang et al. | |
| 4,200,522 A | | 4/1980 | Dorrepaal et al. | 209/166 |
| 4,309,282 A | * | 1/1982 | Smith, Jr. et al. | |
| 4,690,752 A | * | 9/1987 | Shaw | |
| 4,732,666 A | * | 3/1988 | Welgemoed et al. | |
| 5,962,828 A | | 10/1999 | Hughes | 209/166 |
| 6,149,013 A | | 11/2000 | Hughes | 209/166 |

FOREIGN PATENT DOCUMENTS

| | | |
|---|---|---|
| CA | 2092440 | 3/1992 |
| DE | 40 30 160 | 3/1992 |
| DE | 100 24 667 | 11/2001 |
| FR | 2 366 067 | 4/1978 |
| ZA | 90 9347 | 11/1990 |

* cited by examiner

*Primary Examiner*—Thomas M. Lithgow
(74) *Attorney, Agent, or Firm*—Richard P. Silverman; Anthony A. Bisulca

(57) ABSTRACT

The invention relates to a flotation agent for phosphate ore, comprising a fatty acid as collector and alkoxylated alkylphenols as dispersing agents, characterized in that the alkylphenols are composed of a) 8 to 20% by weight of one or more dialkylphenols having alkyl radicals from 8 to 12 carbon atoms b) 80 to 92% by weight of one or more monoalkylphenols having alkyl radicals from 8 to 12 carbon atoms, which have been alkoxylated with 2 to 6 mol of ethylene oxide.

9 Claims, No Drawings

AGENT FOR DRESSING PHOSPHATE ORE

The present invention relates to an improved flotation agent for phosphate ore which, in addition to a fatty acid as collector, comprises a mixture of ethoxylated alkylphenols.

In the flotation of phosphate ore with fatty acids according to ZA-90/9347, it is prior art that the flotation output can be improved by using, in addition to the collector (fatty acid), a dispersing agent, such as, for example, a nonylphenol with 2–5 mol of ethylene oxide (EO) and an aliphatic oxyethylated alcohol with the chain length $C_{11}$–$C_{15}$ which contains 2–4 mol of EO. A further improvement arises if an alcohol with the chain length $C_1$–$C_{15}$ is dissolved in the dispersing agent. This alcohol improves the emulsifiability of the dispersing agent.

Surprisingly, it has now been found that the specific concentration of a reaction product of nonylphenol and 2.75 to 3.25 mol of ethylene oxide during the flotation of phosphate from phosphate ore can be significantly reduced for the same yield and same quality if the nonylphenol used contains 9 to 13% by weight of dinonylphenol instead of the standard 2 to 5% by weight of dinonylphenol. It is also the case that the phosphate yield is even improved by using the dispersing agent according to the invention in the same concentration, without adversely affecting the $P_2O_5$ content in the flotation concentrate.

The invention thus provides a flotation agent for phosphate ore, comprising a fatty acid as collector and alkoxylated alkylphenols as dispersing agents, characterized in that the alkylphenols are composed of a) 8 to 20% by weight of one or more dialkylphenols having alkyl radicals from 8 to 12 carbon atoms b) 80 to 92% by weight of one or more monoalkylphenols having alkyl radicals from 8 to 12 carbon atoms, which have been alkoxylated with 2 to 6 mol of ethylene oxide.

The invention further provides for the use of a mixture of alkoxylated alkylphenols as described above as dispersing agents in the flotation of phosphate ores. In a preferred embodiment, the use takes place with fatty acids as collector.

The dispersing agent preferably comprises 9 to 15% by weight, in particular 10 to 13% by weight, of constituent a). The content of constituent b) is given by the difference to 100% by weight. The alkyl radicals are preferably linear or branched nonyl radicals. The content of ethylene oxide in constituents a) and b) is, in a further preferred embodiment, between 2 and 4 mol, in particular between 2.5 and 3.5 mol. In a further preferred embodiment, the flotation agent according to the invention does not comprise alcohols.

The fatty acid which makes up the main constituent of the flotation agent according to the invention is preferably a linear or branched monocarboxylic acid having 8 to 26 carbon atoms. For this purpose, the fatty acids known in the prior art as collectors can be used.

The flotation agent according to -the invention preferably comprises between 1 and 30% by weight of the dispersing agent. The flotation agent according to the invention is preferably used in amounts of from 100 to 1000 g/t of solid for the flotation of phosphate ores. The amount of dispersing agent according to the invention added in the case of separate collector/dispersing agent dosing is preferably between 30 and 150 g/t, in particular between 40 and 60 g/t, based on the solids charge.

The flotation agent according to the invention can, in addition to said constituents of fatty acid and dispersing agent, comprise depressants or further constituents known from the prior art. Such constituents are, for example, foaming agents and aliphatic polyglycol ethers. In addition, different depressants such as, for example, waterglass, can be used separately.

In the text below the flotation agent according to the invention is presented by way of example:

EXAMPLES

Preparation of Nonyl-/dinonylphenol

The mixture of mono- and dinonylphenol is prepared as follows:

phenol is initially introduced addition of 0.2 eq. of conc. sulfuric acid addition of nonene with stirring internal temperature increases to 30 to 50° C., and hydrogen chloride evolves the reaction is complete when the evolution of hydrogen chloride stops.

On an industrial scale the reaction can be carried out by circulating the phenol/nonene mixture over an acidic fixed bed catalyst. The following mixtures were obtained:

TABLE 1

| Moles of phenol | Moles of nonene | Dinonylphenol content |
|---|---|---|
| 1 | 0.9 | 9% by weight |
| 1 | 1.0 | 11% by weight |
| 1 | 1.1 | 13% by weight |
| Comparison | | |
| 1 | 0.6 | 3% by weight |

Preparation of Nonyl-/dinonylphenol Ethoxylate

The ethoxylation of nonylphenol was carried out in the following steps:

Introduce the nonylphenol into a clean reactor.

Switch on the stirrer.

Add or suck in the given amount of sodium hydroxide solution (as catalyst).

Heat the reactor contents with stirring to 85–90° C., then apply a vacuum.

Lift the vacuum with nitrogen and heat the reactor contents with stirring to 140–145° C.

Meter in ethylene oxide at this temperature.

Further meter in ethylene oxide until the calculated amount is reached.

After-stir for about 1 hour at a bottom temperature of 140–150° C. until the ethylene oxide reaction is complete.

Take a sample and determine the OH number or cloud point and stir further at 140–150° C. until a good result is obtained.

If the target OH number or target cloud point has still not been reached, the calculated amount of ethylene oxide must then be added to the reactor contents.

If the target OH number is reached, the reactor contents are cooled to 100° C. and outgassed under vacuum at 100° C.

The mixture is neutralized at 50–70° C. with acetic acid to a pH range from 6.0–8.0.

The following results were obtained:

TABLE 2

| Starting materials | | |
|---|---|---|
| Raw material | Moles | Amount |
| Nonyl-/dinonylphenol | 1 | 231.3/233.9/236.4 kg[1] |
| Ethylene oxide | 3 | 132 kg |
| NaOH (50% strength) | 0.006 | 0.24 kg |
| Acetic acid (technical-grade purity) | 0.006 | 0.36 kg |

[1]with 9.11 or 13% dinonylphenol content

TABLE 3

| Substances obtained | | |
|---|---|---|
| | Dinonylphenol content | Nonylphenol/ethylene oxide molar ratio |
| Example 1 | 9% | 1:3 |
| 2 | 11% | 1:3 |
| 3 | 13% | 1:3 |
| Comparison | 3% | 1:4 |

Applications-related investigations

TABLE 4

| Reagents in g/t of solid | | | | | |
|---|---|---|---|---|---|
| | Fatty acid | Dispersing agent | Charge $P_2O_5$ in % | Concentrate $P_2O_5$ in % | Yield |
| Comparison | 430 | 81 | 7.2 | 38.1 | 89.8 |
| Example 1 | 430 | 65 | 6.2 | 38.5 | 87.2 |
| Example 2 | 430 | 54 | 6.0 | 38.1 | 89.8 |
| Example 3 | 430 | 43 | 5.7 | 37.7 | 92.4 |

TABLE 5

| Reagents in g/t | | | | | |
|---|---|---|---|---|---|
| | Fatty acid | Dispersing agent | Charge $P_2O_5$ in % | Concentrate $P_2O_5$ in % | Yield |
| Comparison | 400 | 150 | 7.3 | 39.9 | 71.3 |
| Example 2 | 400 | 150 | 7.8 | 40.1 | 76.2 |
| Example 3 | 400 | 150 | 8.1 | 40.3 | 76.4 |

Evaluation

With the novel dispersing agent (Table 4, Examples 1–3) the concentration can be reduced, relative to the comparison product, from 81 g/t to 40 to 60 g/t without impairing the concentrate quality or the yield.

If conventional dispersing agent (comparative experiment) and dispersing agent according to the invention (Examples 2 and 3) are added in identical amounts (Table 5), a significant improvement in the phosphate yield is achieved with constant concentrate quality.

Composition of the crude ore:

| | |
|---|---|
| Apatite | 22% by weight |
| Phlogopite | 24% by weight |
| Calcite | 25% by weight |
| Dolomite | 3% by weight |
| Forsterite | 7% by weight |
| Diopside | 8% by weight |

What is claimed is:

1. A flotation agent for phosphate ore, comprising:

a) a fatty acid; and, b) alkoxylated alkylphenols having

I) 8 to 20% by weight of one or more dialkylphenols having alkyl radicals from 8 to 12 carbon atoms, and II) 80 to 92% by weight of one or more monoalkylphenols having alkyl radicals from 8 to 12 carbon atoms, wherein the dialkylphenols and monoalkylphenols have been alkoxylated with 2 to 6 moles of ethylene oxide.

2. The flotation agent as claimed in claim 1, wherein the alkoxylated alkylphenols comprise nonylphanol ethoxylates.

3. The flotation agent as claimed in claim 1, wherein the alkoxylated alkylphenols comprise 9 to 15% by weight of one or more dialkylphenols.

4. The flotation agent as claimed in claim 1, wherein the diaklyphenols and monoalkylphenols have been alkoxylated with between 2 and 4 moles of ethylene oxide.

5. The flotation agent as claimed claim 1, wherein the alkoxylated alkylphenols comprise essentially no alcohol.

6. A process for the flotation of phosphate ore comprising contacting the phosphate ore with from 100 to 1000 g/t of phosphate ore with the flotation agent of claim 1.

7. A process for the flotation of phosphate ore comprising contacting the phosphate ore with a flotation agent comprising a collector, and a dispersing agent, said collector comprising a fatty acid comprising a linear or branched monocarboxylic acid having 8 to 26 carbons per molecule, said dispersing agent comprising alkoxylated aklyphenols having:

a) 8 to 20% by weight of one or more dialkylphenols having alkyl radicals from 8 to 12 carbon atoms, and b) 80 to 92% by weight of one or more monoalkylphenols having alkyl radicals from 8 to 12 carbon atoms, wherein the dialkylphenols and monoalkylphenols have been alkoxylated with 2 to 6 moles of ethylene oxide.

8. The process of claim 7 wherein the dialkylphenols and monoalkylphenols have been alkoxylated with 2.5 to 3.5 moles of ethylene oxide.

9. The process of claim 7 wherein the flotation agent comprises 1 to 30 percent by weight of dispersing agent.

* * * * *